US006242703B1

(12) United States Patent
Castonguay et al.

(10) Patent No.: US 6,242,703 B1
(45) **Date of Patent: *Jun. 5, 2001**

(54) BELL ALARM WITH AUTOMATIC RESET FOR SMALL FRAME AIR CIRCUIT BREAKER

(75) Inventors: Roger N. Castonguay, Terryville; Dean A. Robarge, Southington, both of CT (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/006,788

(22) Filed: Jan. 14, 1998

(51) Int. Cl.[7] ..... H01H 73/12

(52) U.S. Cl. ..... 200/308

(58) Field of Search ..... 200/308, 51.01, 200/322, 324, 325; 340/638, 644; 335/17

(56) References Cited

U.S. PATENT DOCUMENTS

| | | | | |
|---|---|---|---|---|
| 3,084,238 | | 4/1963 | Baskerville . | |
| 3,095,489 | | 6/1963 | Baird . | |
| 4,211,989 | * | 7/1980 | Acampora | 335/17 |
| 4,672,501 | | 6/1987 | Bilac et al. | 361/96 |
| 5,502,286 | | 3/1996 | Pollman | 200/401 |

* cited by examiner

*Primary Examiner*—Renee Luebke
(74) *Attorney, Agent, or Firm*—Cantor Colburn LLP; Carl B. Horton

(57) ABSTRACT

An air circuit breaker bell alarm accessory interacts with the circuit breaker closing system to allow automatic resetting of the bell alarm module upon resetting of the circuit breaker operating mechanism. A lockout slide extends between the bell alarm module support and the bell alarm reset slide to automatically reset the bell alarm module prior to closing of the circuit breaker contacts.

12 Claims, 6 Drawing Sheets

BELL ALARM WITH AUTOMATIC RESET FOR SMALL FRAME AIR CIRCUIT BREAKER

BACKGROUND OF THE INVENTION

Air circuit breakers as described within U.S. Pat. No. 3,095,489 entitled "Manual Charging Means for Stored Energy Closing Mechanisms of Electric Circuit Breakers" and U.S. Pat. No. 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

Various accessory devices are used with such air circuit breakers to provide auxiliary function along with overcurrent protection. One such accessory is the bell alarm accessory that provides local and remote indication as to the occurrence of circuit interruption. U.S. Pat. No. 5,502,286 entitled "Bell Alarm and Lock-Out for High Ampere-Rated Circuit Breakers" describes a bell alarm accessory used with so-called "insulated case" circuit breakers wherein the circuit breaker interrupting components are completely enclosed within an insulating plastic enclosure. This patent describes one such bell alarm accessory that interacts with the circuit breaker operating mechanism to activate the bell alarm upon circuit interruption and to prevent the closing of the circuit breaker contacts until the accessory is manually reset.

U.S. patent application Ser. No. 08/875,595 filed on Jun. 19, 1997 entitled "Circuit Breaker Bell Alarm Accessory with Lockout" provides a bell alarm accessory that provides local as well as remote indication of such circuit interruption as well as preventing circuit breaker contact closure until and unless the accessory has become manually reset. The bell alarm accessory described therein is similar to that disclosed within U.S. Pat. No. 5,502,286 entitled "Bell Alarm Accessory Module".

In most circuit breakers employing a bell alarm for status indication of the circuit breaker contacts, it is a requirement that the circuit breaker operating mechanism be reset before the bell alarm can be manually reset to indicate the circuit breaker closed condition. It would be more convenient, in certain applications, to allow the bell alarm accessory to become automatically reset immediately upon closure of the circuit breaker contacts without the requirement of manual intervention.

One example of a bell alarm automatic reset function in high-ampere rated air type circuit breakers is found within U.S. patent application Ser. No. 08/904,324 filed Jul. 31, 1997 entitled "Circuit Breaker Bell Alarm Accessory with Automatic Reset".

Such high-ampere rated air type circuit breakers operate in the range of 2500 to 5000 amperes such that the large circuit breaker operating components are arranged with the bell alarm reset components in a particular manner. When low-ampere rated air type circuit breakers that operate in the range of 150 to 1500 amperes require bell alarms with automatic reset function, the arrangement of the circuit breaker operating smaller components do not readily allow the use of the high-ampere rated bell alarm reset accessory.

One purpose of the invention is to describe a bell alarm accessory for use with smallampere rated air type circuit breakers that is automatically reset upon response of the smallampere rated circuit breaker operating mechanism to close the circuit breaker contacts.

SUMMARY OF THE INVENTION

An air circuit breaker bell alarm accessory interacts with the circuit breaker closing system to allow automatic resetting of the bell alarm module upon resetting of the circuit breaker operating mechanism. A lockout slide extends between the bell alarm module support and the bell alarm reset slide to automatically reset the bell alarm module prior to closing of the circuit breaker contacts. A reset arm assembly on the bell alarm module support interacts with a reset bypass cam on the reset slide to insure that the bell alarm module is active immediately prior to re-closure of the circuit breaker contacts to allow the bell alarm to operate immediately upon contact closure.

DESCRIPTION OF THE PREFERRED EMBODIMENT

Figure 1:
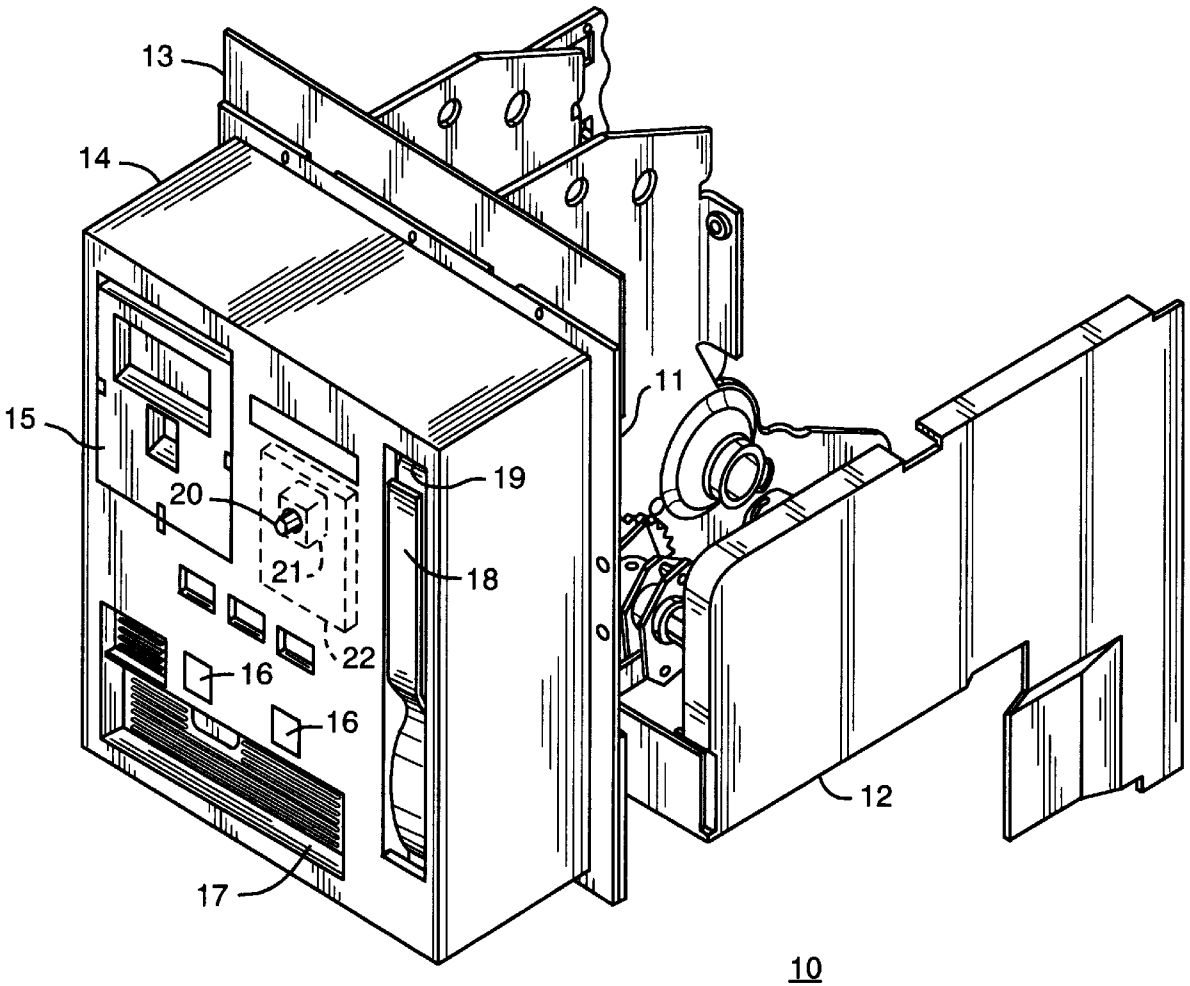
FIG. 1 is top perspective view of an air circuit breaker containing the bell alarm reset unit attached to a front part of the circuit breaker contact closing assembly in accordance with the invention.

The air circuit breaker 10 of FIG. 1 is shown attached to the circuit breaker cover plate 13 interfacing with the circuit breaker contact closing assembly 11 that is positioned between the circuit breaker operating mechanism sideframes 12 similar to that described within the aforementioned U.S. Pat. No. 3,095,489. The circuit breaker cover 14 supports the trip unit programmer 15 which programmer is similar to that described in U.S. Pat. No. 4,672,501 entitled "Circuit Breaker and Protective Relay Unit". The circuit breaker cover includes buttons 16 for releasing the circuit breaker operating mechanism (not shown) circuit breaker contacts (not shown) to their OPEN condition and for moving the contacts to their CLOSED condition. The circuit breaker operating handle 18, positioned within the handle recess 19, allows manual interaction with the contact springs closing mechanism 11 to both open and close the circuit breaker contacts. An accessory such as a bell alarm module 21, similar to that described in the aforementioned U.S. Pat. No. 5,502,286 is mounted on a bell alarm reset assembly 22 to provide visual indication of the occurrence of contact separation by means of the pop-up target 20. Other circuit breaker accessories can be inserted within the accessory recess 17, if so desired.

Figure 2:
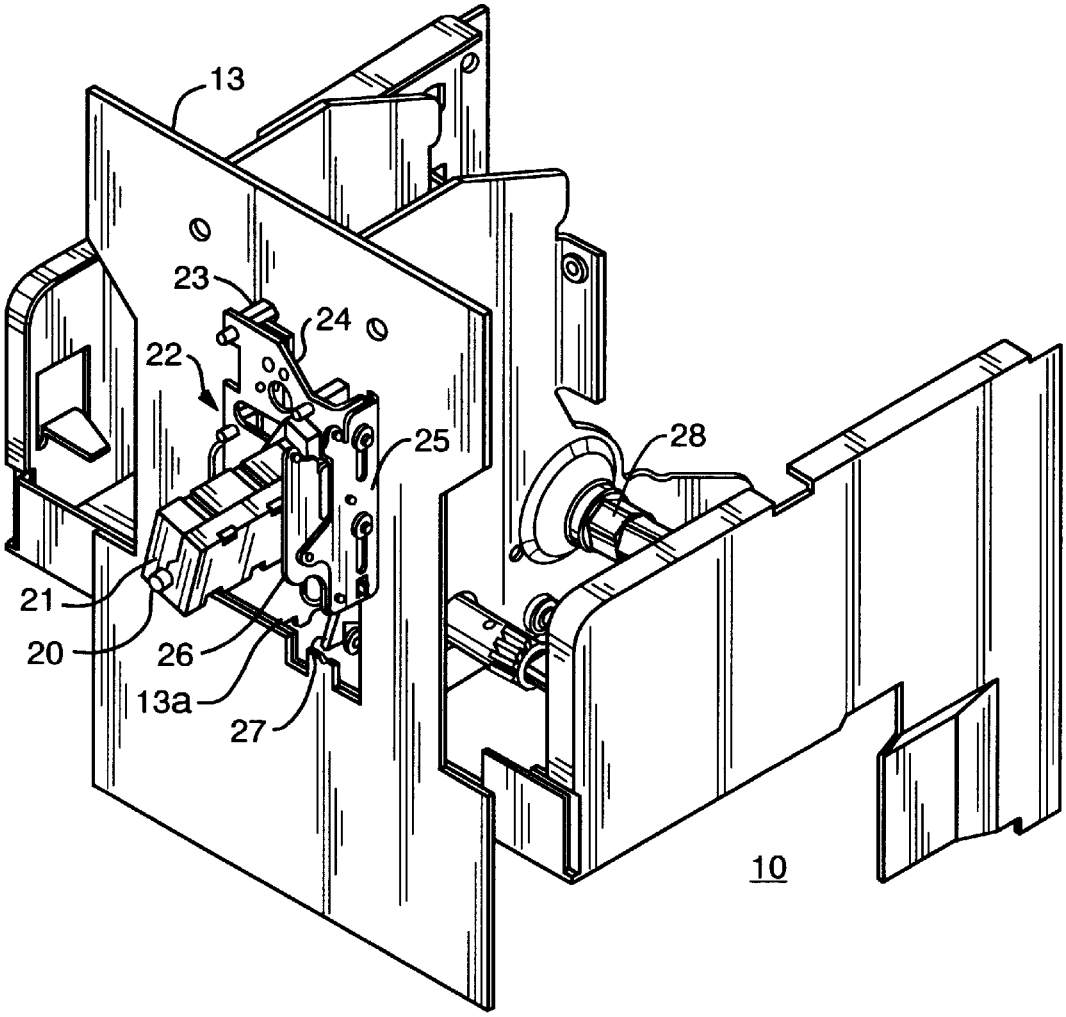
FIG. 2 is a top perspective view of the air circuit breaker of FIG. 1 with the circuit breaker cover removed to depict the bell alarm module and bell alarm reset.

The circuit breaker 10 of FIG. 1 is depicted in FIG. 2 with the circuit breaker cover removed from the circuit breaker cover plate 13 to illustrate the position of the bell alarm module 21 on the bell alarm reset assembly 22 which is arranged on the bell alarm support plate 24 over a rectangular aperture 13A formed in the cover plate 13. In the contact CLOSED condition, the bell alarm pop-up target 20 is unextended from the bell alarm module 21 and becomes extended therefrom upon occurrence of contact separation during circuit overload conditions. The bell alarm support plate 24 is fastened to the cover plate 13 by means of mounting studs 23 and the reset slide 25 that carries the reset bypass cam 26 is attached to the side thereof for interaction with the circuit breaker closing shaft operating lever 27 in the manner to be described below.

Figure 3:
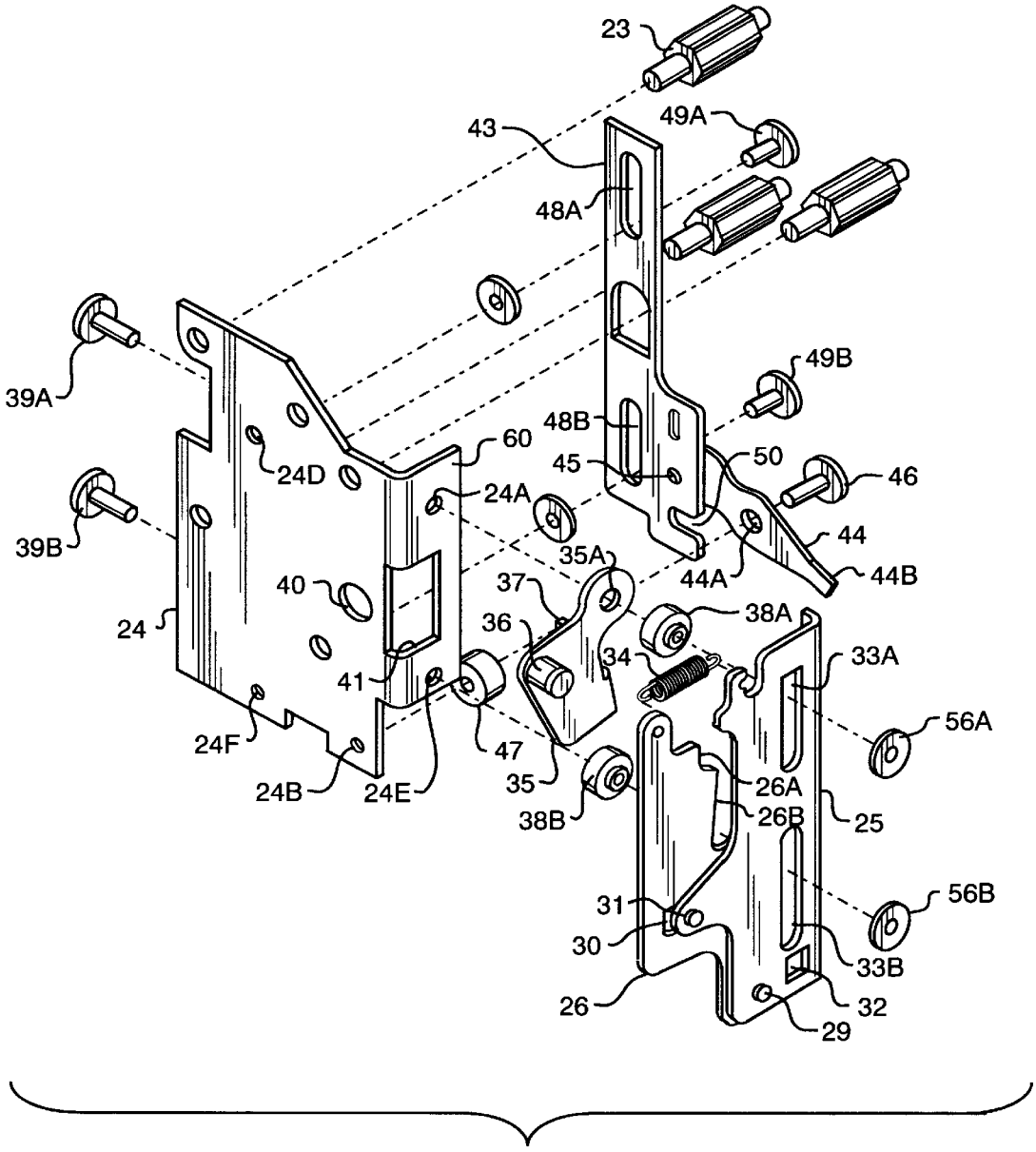
FIG. 3 is an exploded top perspective view of the components contained within the bell alarm unit of FIGS. 1 and 2 arranged in isometric projection prior to attachment to the circuit breaker.

The bell alarm reset assembly 22 is depicted now in FIG. 3 prior to assembly of the bell alarm assembly components. The bell alarm reset assembly support plate 24 and reset slide 25 are similar to those described in the aforementioned U.S. patent application Ser. No. 08/904,324. In accordance with the invention, a reset arm 35 is positioned between the support plate 24 and the reset slide 25 and is attached to the support plate by means of rivet 39A, apertures 24A, 35A, bushing 38A, slot 33A and locking washer 56A. A similar rivet 39B, aperture 24E, bushing 38B, slot 33B and locking washer 56B are used to fasten the other side of the support plate 24 to the other side of the reset slide 25. The reset arm tab 37 extends through the elongated slot 41 formed in the side tab 60 of the support plate 24 while the reset arm cam roller 36 extends under the cam surfaces 26A, 26B formed on the reset bypass cam 26 that is attached to the top of the reset slide 25 by means of the pivot pin 29 and the guide pin 31 extending through the cam slot 30 and the reset bypass cam return spring 34. A bypass lever 44 is attached to the lockout slide 43 shown in FIG. 4B by means of a pivot pin 45 and is attached to the support plate 24 by means of a rivet 46, aperture 44A, bushing 47 and aperture 24B. The tab 44B on the end of the bypass lever 44 is captured within the slot 32 formed on the end of the reset slide 25. The lockout slide 43 is slidingly positioned on the bottom of the support plate 24 by means of rivets 49A, 49B, elongated slots 48A, 48B, and apertures 24D, 24F. With the components secured thereto, the bell alarm rest assembly 22 is next positioned on the circuit breaker cover plate 13 (FIG. 2) and attached thereto by means of the mounting studs 23, as shown earlier. The bell alarm plunger receiving hole 40 automatically aligns with the bell alarm module lockout plunger 51 (FIG. 5) by reception therein of a position pin (not shown) that extends from the bottom of the bell alarm module 21 (FIG. 2).

Figure 4B:
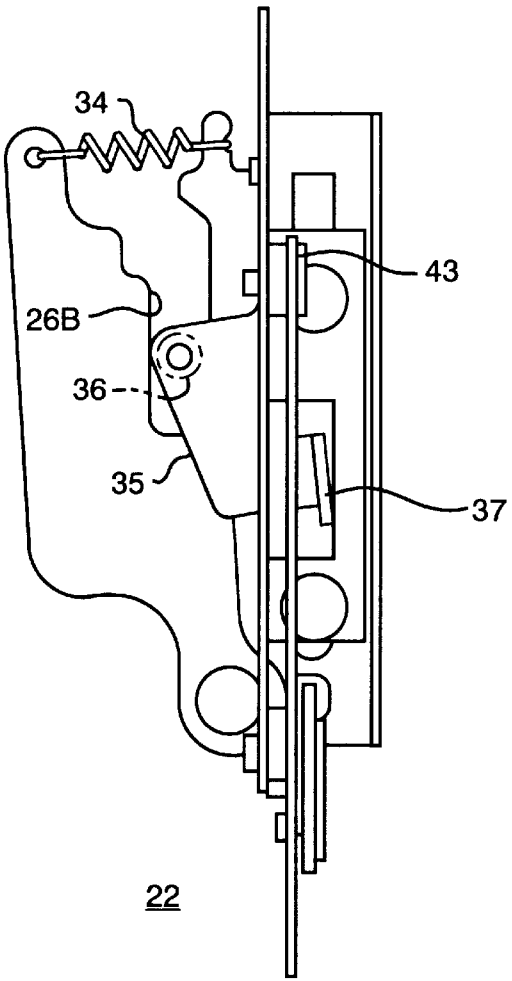
FIG. 4B is an enlarged side view of the bell alarm reset unit of FIG. 3 with the circuit breaker contacts in the CLOSED condition.
Figure 4A:
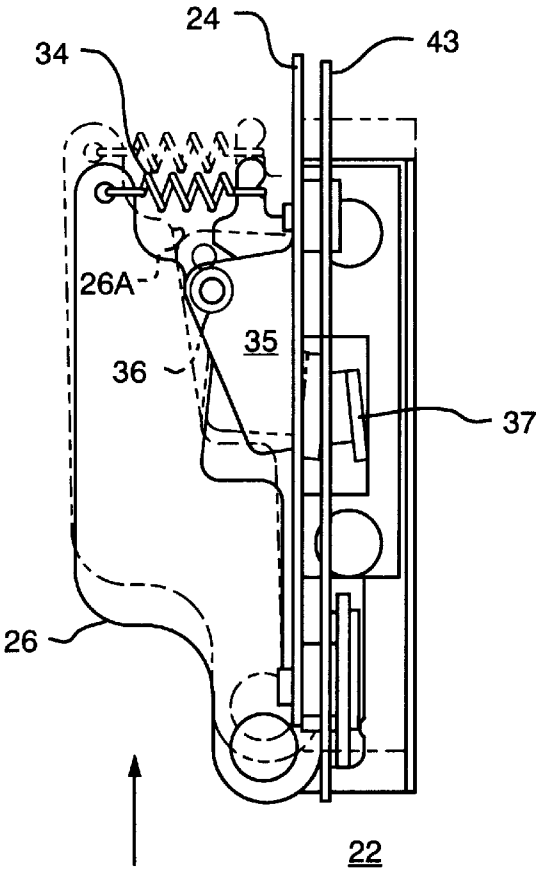
FIG. 4A is an enlarged side view of the bell alarm reset unit of FIG. 3 with the circuit breaker contacts in the OPEN condition.

The functional relationship between the reset bypass cam 26 and the reset arm 35 is best seen by now referring to FIGS. 4A, 4B wherein the bell alarm reset unit 22 is shown prior to attaching to the circuit breaker cover plate 13 of FIG. 2. In the quiescent current operating or home condition of the bell alarm reset unit, as depicted in solid lines in FIG. 4A, the reset arm tab 37 is extended away from the bottom of the lockout slide 43, attached to the bottom of the support plate 24. The cam roller 36 on the reset arm 35 is positioned under the cam surface 26A on the reset bypass cam 26. Upon occurrence of an overcurrent condition within the circuit protected by the circuit breaker 10, of FIG. 1, the bell alarm pop-up target 20 on the bell alarm module 21 of FIG. 2 extends to display the fault occurrence, and the plunger 51 of FIG. 5 extends until the bell alarm module is reset. To allow the bell alarm module to become reset in accordance with the invention, the translation of the lockout slide plate 43 in the indicated direction along the bell alarm reset support plate 24 moves the reset bypass cam 26 to the position indicated in phantom whereby the reset arm tab 37 moves upwards toward the bottom of the bell alarm reset support plate. Further movement in the indicated direction positions the cam roller 36 on the reset arm 35 under the cam surface 26B returning the reset arm tab 37 to the home position in solid lines, extending the return spring 34 as shown in FIG. 4B. The bell alarm reset unit 22 is now ready for operation so that the bell alarm module plunger 51 (FIG. 5) and bell alarm target 20 (FIG. 2)on the bell alarm module 21 (FIG. 2) have retracted to their home positions. The immediate return of the reset arm tab 37 to the home position insures that the bell alarm module becomes operative to indicate the occurrence of an overcurrent condition before the closing spring shaft has rotated to close the circuit breaker contacts. This action is an important feature of the invention since a fault occurrence upon contact closure would be immediately signaled by extension of the bell alarm target 20.

Figure 5:
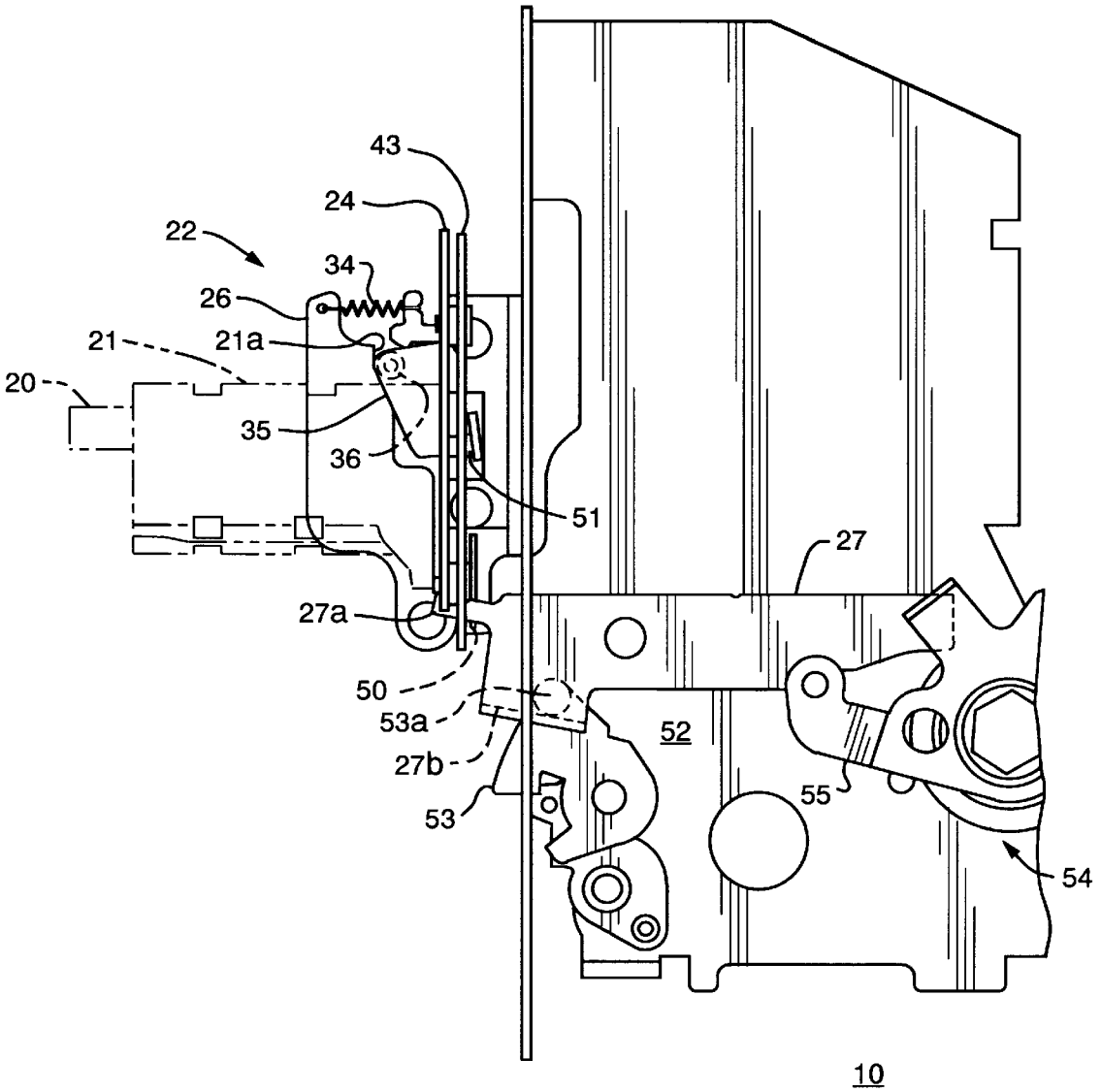
FIG. 5 is an enlarged side view of the circuit breaker of FIG. 2 depicting the interaction of the bell alarm reset unit with the bell alarm module and circuit breaker closing shaft assembly when the circuit breaker contacts are in the OPEN condition.
Figure 6:
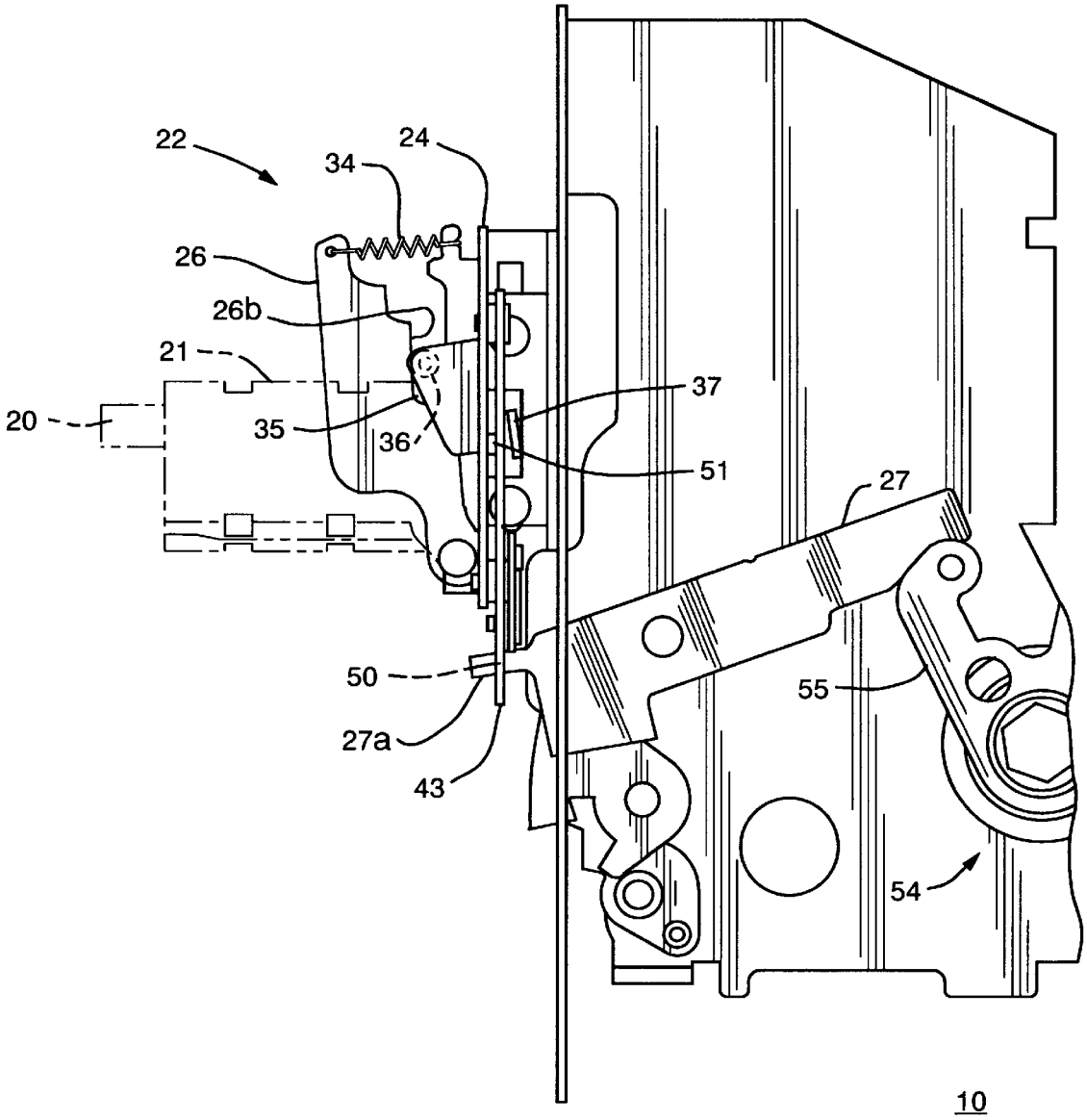
FIG. 6 is an enlarged side view of the circuit breaker of FIG. 2 depicting the interaction of the bell alarm reset unit with the bell alarm module and circuit breaker closing shaft assembly when the circuit breaker contacts are in the CLOSED condition.

The bell alarm reset unit 22 is shown attached to the circuit breaker 10 in FIGS. 5 and 6 and the bell alarm module 21 is shown in phantom mounted to the bell alarm reset unit for describing the interaction now between the circuit breaker closing shaft 54 and closing shaft cam 55, within the closing shaft interlock assembly 52, with the bell alarm reset unit 22 during reset of the bell alarm module 21. The operation of the circuit breaker closing shaft and closing shaft interlock assembly relative to the circuit breaker contacts is described in U.S. patent application Ser. No. 08/863,649 entitled "Ratcheting Mechanism for Industrial-Rated Circuit Breaker" filed May 27, 1997.

In accordance with the invention, the bell alarm reset unit 22 interacts with the circuit breaker closing shaft 54 by capture of the tab 27A, extending from the closing system operating lever 27 within the slot 50 formed at the end of the lockout slide 43 subjacent the bell alarm support plate 24, and by capture of the post 53A on the bell crank lever 53 by the tab 27B formed on the end of the operating lever 27. In the circuit breaker TRIPPED condition depicted in FIG. 5, the bell alarn pop-up target 20 has become extended from the top of the bell alarm module 21 to provide visible indication that the circuit breaker contacts have become separated. At the same time, the plunger 51, becomes extended from the bottom of the bell alarm module and must be returned to a recessed position to reset the bell alarm pop-up target 20 in the manner described within the aforementioned U.S. Pat. No. 5,502,286. The cam roller 36 on the reset arm 35 is trapped under the cam surface 21A on the reset bypass cam 26 by the bias provided by the rest cam return spring 34.

The clockwise rotation of the closing shaft 28 (FIG. 2) and closing shaft cam 55 to return the circuit breaker contacts to the CLOSED condition, rotates the operating lever 27 in the bell alarm reset unit 22 in the counterclockwise direction driving the lockout slide 43 under the support plate 24 in the direction indicated in FIG. 6 by capture of the operating lever tab 27A within the lockout slide retainer slot 50. The translation of the lockout slide 43 was shown earlier in FIG. 4A to drive the reset arm tab 37 upwards against the bottom of the support plate 24 which contacts the end of the bell alarm plunger 51 on the bottom of the bell alarm module 21 to the retracted position shown in FIG. 6, which resets the bell alarm target 20 on the top of the bell alarm module to the retracted position. The reset arm tab 37 returns to the home position depicted in FIG. 4B and FIG. 6 away from the end of the bell alarm plunger 51 to allow the bell alarm target 20 to extend upon occurrence of an overcurrent condition within the associated electric circuit connected with the circuit breaker 10. The reset arm 35 has rotated counter-clockwise to position the cam roller 36 under the cam surface 26B of the reset bypass cam 26 against the bias of the extended return spring 34 and the circuit breaker contacts have now become returned to the CLOSED condition.

The bell alarm module has herein been shown to become automatically reset from the circuit breaker contact TRIPPED indication to the circuit breaker contact CLOSED condition prior to the closing of the circuit breaker contacts in a single, continuous operation.

What is claimed is:

1. An apparatus for use with a circuit breaker bell alarm accessory and a circuit breaker mechanism comprising:

a coupling linkage in mechanical communication with said circuit breaker mechanism for effecting an open circuit breaker state and a closed circuit breaker state, whereupon activation of said coupling linkage effects transition from said open circuit breaker state to said closed circuit breaker state, and thereby initiates a reset mechanism;

a reset arm arranged for interacting with said bell alarm accessory and further arranged for interacting with said coupling linkage;

whereupon said coupling linkage effects a transition from said open circuit breaker state to said closed circuit breaker state, thereby effecting a reset wherein said reset is effected by said reset arm; and whereupon said reset arm causes said bell accessory to reset prior to closing contacts of said circuit breaker mechanism.

2. An apparatus for use with a circuit breaker bell alarm accessory and a circuit breaker mechanism comprising:

a reset arm in mechanical communication with said bell alarm accessory;

a coupling linkage in mechanical communication with said reset arm and in further mechanical communication with said circuit breaker mechanism for effecting:

an open circuit breaker state;

a closed circuit breaker state;

whereupon activation of said coupling linkage effects transition from said open circuit breaker state to said closed circuit breaker state, and thereby effecting a reset wherein said reset is effected by said reset arm; and whereupon said reset arm causes said bell accessory to reset prior to closing contacts of said circuit breaker mechanism.

3. An apparatus for use with a circuit breaker bell alarm accessory and a circuit breaker mechanism comprising:

a support platform arranged for mounting to a circuit breaker mechanism, said support platform further arranged for receiving and supporting a circuit breaker bell alarm accessory;

a reset arm pivotally attached to said support platform about a reset arm pivot axis;

a reset slide slidably mounted to said support platform, a reset bypass cam pivotally mounted to said reset slide;

a lockout slide slidably mounted to said support platform, said lockout slide having a slot for interacting with a circuit breaker closing system operating lever;

a bypass lever pivotally mounted on said support platform, said bypass lever having a first end arranged to interact with said lockout slide and a second end arranged to interact with said reset slide; and said reset arm arranged for interacting with said bell alarm accessory and further arranged for interacting with said reset bypass cam.

4. An apparatus as in claim 3 wherein said support platform further comprises:

a first portion having a first aperture and a tab;

said first aperture arranged for receiving a plunger from said circuit breaker bell alarm accessory;

said tab extending from said first portion in an essentially perpendicular manner; and said tab having a second aperture;

wherein said reset slide is slidably mounted on said tab; and wherein said reset arm is pivotally mounted on said tab.

5. An apparatus as in claim 4 wherein said reset arm further includes a cam roller mounted on a cam roller shaft extending essentially perpendicular from said reset arm; and a reset arm tab extending essentially perpendicular from said reset arm;

wherein a normal to said reset arm tab passes through said first aperture of said first portion; and wherein said cam roller shaft is parallel to said reset arm pivot axis.

6. An apparatus as in claim 4 wherein said plunger optionally extends through said aperture for interaction with said reset arm.

7. An apparatus as in claim 3 wherein said reset bypass cam further comprises:

a plurality of cam following surfaces;

a cam slot for receiving a guide pin mounted on said reset slide; and a cam return spring for urging said reset bypass cam towards said reset arm.

8. An apparatus as in claim 7 further comprising:

a cam roller mounted on a cam roller shaft extending essentially perpendicular from said reset arm; and said plurality of cam following surfaces include a first cam following surface and a second cam following cam following surface such that said first and second cam following surfaces are contiguous;

wherein said lockout slide is slidably urged by said circuit breaker closing system operating lever between a circuit breaker open position and a circuit breaker closed position;

wherein said bypass lever first end mechanically responsive to said lockout slide and said bypass lever second end urging said reset slide to slide between said circuit breaker open position and said circuit breaker closed position;

wherein said reset bypass cam slides with said reset slide while said cam roller follows said cam following surfaces;

wherein when said reset slide is in the circuit breaker closed position, said cam roller is following said first cam following surface and wherein when said reset slide is in the circuit breaker open position, said cam roller is following said second cam following surface wherein when said reset slide transitions from said circuit breaker closed position to said circuit breaker open position, said cam roller follows along said first cam following surface to said second cam following surface without causing any rotation of said reset arm wherein when said reset slide transitions from said circuit breaker open position to said circuit breaker closed position, said reset arm is first urged by said cam roller following said second cam following surface to rotate so as to move said plunger to a reset position causing said bell accessory to reset;

wherein as said reset arm hits a stop causing said reset arm rotation to stop, said cam roller follows onto said first cam following surface which drives said reset arm back to said reset arm open position.

9. An apparatus as in claim 3 wherein said support platform is adapted for attaching to a circuit breaker mechanism enclosure.

10. An apparatus as in claim 3 wherein:

said reset arm pivots between a reset stop and a normal stop;

said lockout slide is slidably urged by said circuit breaker closing system operating lever between a circuit breaker open position and a circuit breaker closed position;

said bypass lever first end mechanically responsive to said lockout slide and said bypass lever second end urging said reset slide to slide between a circuit breaker open position and a circuit breaker closed position simultaneously with said lockout slide;

said reset bypass cam sliding with said reset slide between a circuit breaker open position and a circuit breaker closed position simultaneously with said lockout slide;

whereupon when said reset bypass cam transitions from said circuit breaker closed position to said circuit breaker open position, said reset bypass cam does not cause any rotation of said reset arm;

whereupon when said reset bypass cam transitions from said circuit breaker open position to said circuit breaker closed position, said reset arm is first urged by said reset bypass cam to rotate from said normal stop to said reset stop so as to move said plunger to a reset position causing said bell accessory to reset; and whereupon when said reset arm reaches said reset stop, said reset bypass cam secondly urges said reset arm back to said normal stop.

11. An apparatus as in claim 10 wherein:

said reset bypass cam secondly urges said reset arm back to said normal stop before said reset bypass cam reaches said circuit breaker closed position.

12. An apparatus as in claim 3 wherein:

said support platform is of essentially planar construction;

said lockout slide is of essentially planar construction;

said reset slide is of essentially planar construction;

said reset bypass cam is of essentially planar construction;

said reset arm is of essentially planar construction; and said bypass lever is of essentially planar construction.

* * * * *